United States Patent [19]

Van Nette, III

[11] 4,422,495

[45] Dec. 27, 1983

[54] MOLD HANDLING SYSTEM

[75] Inventor: Adair B. Van Nette, III, Clinton Township, Seneca County, Ohio

[73] Assignee: Joseph B. Stinson Co., Fremont, Ohio

[21] Appl. No.: 238,342

[22] Filed: Feb. 26, 1981

[51] Int. Cl.[3] ..... B22D 5/02; B22D 5/00; B22D 47/02; B22D 33/04

[52] U.S. Cl. ..... 164/324; 164/167; 164/323; 164/341; 164/394

[58] Field of Search ..... 164/322, 323, 324, 341, 164/329, 331, 394, 130, 167

[56] References Cited

U.S. PATENT DOCUMENTS

| | | | |
|---|---|---|---|
| 2,095,151 | 10/1937 | O'Connor et al. . | |
| 2,407,334 | 9/1946 | Wessel | 164/323 |
| 2,767,865 | 7/1956 | Lasater et al. | 214/40 |
| 2,792,603 | 5/1957 | Anderson | 164/394 |
| 2,956,316 | 10/1960 | Deakins et al. . | |
| 3,272,147 | 9/1966 | Cakora | 104/1 |
| 3,517,728 | 6/1970 | Taccone | 164/255 |
| 3,605,869 | 9/1971 | Chapman et al. | 164/130 X |
| 3,821,978 | 7/1974 | Kauffman | 164/323 X |
| 3,955,613 | 5/1976 | Lund | 164/130 |
| 3,989,094 | 11/1976 | Gorenflo et al. | 164/324 |
| 4,224,979 | 9/1980 | Rosin et al. | 164/130 |
| 4,299,269 | 10/1981 | Friesen et al. | 164/324 |

FOREIGN PATENT DOCUMENTS

| | | | |
|---|---|---|---|
| 2145489 | 3/1973 | Fed. Rep. of Germany | 164/167 |
| 53-44431 | 4/1978 | Japan | 164/323 |

*Primary Examiner*—Gus T. Hampilos
*Assistant Examiner*—Jerold L. Johnson
*Attorney, Agent, or Firm*—Flynn, Thiel, Boutell & Tanis

[57] ABSTRACT

A mold handling system and method wherein cars are moved along a closed vertical loop. A first elevator positions an empty car adjacent a mold-supply conveyor, whereupon a mold is pushed onto the car, after which the car is transferred into a pre-pour mold storage. The mold-bearing car is then moved onto a second elevator which lifts the car upwardly adjacent an elevated pouring deck. As the mold is elevated, a jacket and weight are automatically deposited thereon, and the mold is poured while the car rests on the second elevator. The mold-bearing car is then moved forwardly through a jacket-and-weight transfer station, after which the jacket and weight are automatically removed and recycled back for positioning on another mold arriving on the second elevator. The mold-bearing car is moved through a cooling region, and this is then transferred onto a third elevator which is tiltable so that the mold is dumped from the car. The third elevator is lowered and the supply car is transferred onto a lowermost return guide rail which transfers the empty cars back to the first elevator. The return guide rail and a portion of the pre-pour mold storage extend in parallel relationship beneath the elevated pouring deck.

12 Claims, 12 Drawing Figures

11
12
13
16
17
29
32
33
34
36
37
38
39
39A
39B
41
42
42A
42B
43
43,81
44,82
69,94
71
72
73
74
76
157

MOLD HANDLING SYSTEM

FIELD OF THE INVENTION

This invention relates to an improved mold handling system employing a plurality of mold cars which are recirculated along a closed path.

BACKGROUND OF THE INVENTION

The handling of molds in foundries involves extensive manual manipulation and control during the handling and transfer of individual molds, and hence the manufacture of castings has necessarily been extremely time-consuming and inefficient. While various apparatus have been introduced into foundries to facilitate the handling or filling or transporting of molds, nevertheless most of the technology has related solely to individual work stations or operations, and hence has not successfully or significantly improved the overall casting operation. Further, most casting operations have employed many discrete and seemingly unrelated apparatus which are utilized for carrying out the complete casting process. The resulting system is such as to occupy an undesirably large space within the foundry, so that optimum and efficient production within minimal working space has been a long sought-after but seldom achieved objective.

Thus, the present invention relates to an improved mold handling system, specifically a system of the type which utilizes recirculating mold cars confined for displacement along a closed loop or path, for permitting efficient handling of molds both before and during pouring, and efficient handling of molds during cooling and dumping thereof, with the empty cars being efficiently returned so as to be reused. This improved system performs in an efficient and effective manner, requires only minimal manual supervision and control, permits maximum storage of a large number of molds both prior to and after pouring, and occupies minimal space within the foundry.

In the improved mold handling system of this invention, the cars are moved along a closed loop which projects vertically for minimizing required floor space. The empty cars are vertically raised by a first elevator located at one end of the loop for positioning an empty car adjacent a mold-handling conveyor, whereupon one or more molds are pushed onto the empty car, from which it is transferred into a pre-pour mold storage. From this storage the mold-bearing car is moved forwardly along a guide rail onto a second elevator which lifts the car upwardly adjacent an elevated pouring deck. As the mold is elevated, a jacket and weight are automatically deposited thereon, and the mold is poured while the car rests on the second elevator. The mold-bearing car is then moved forwardly along a guide rail through a jacket-and-weight transfer station. When reaching the end of this station, the jacket and weight are automatically removed and recycled back for positioning on another mold arriving on the second elevator. After the jacket and weight are removed, the mold-bearing car is moved forwardly along the guide rail through a cooling region, which region may be of two levels with the individual cars being positioned on either level by means of elevators. Upon reaching the end of the cooling section, the mold car is transferred onto a third elevator which, when in its raised position, is tiltable so that the mold is dumped from the car, with the car being cleaned by a suitable brush. After dumping, the third elevator is lowered and the mold car transferred onto a lowermost return guide rail which, through a walking beam arrangement, transfers the empty cars back to the first elevator. The return guide rail, together with at least a portion of the rail defining the pre-pour mold storage, extends in parallel relationship beneath the elevated pouring deck so that a maximum number of cars can be recirculated along the path while minimizing the required floor space within the foundry.

This invention also relates to an improved method for handling molds, specifically a method which involves a recirculating system of cars, which method is explained in greater detail hereinafter.

Other objects and purposes of the invention will be apparent after reading the following specification and inspecting the accompanying drawings.

DETAILED DESCRIPTION

Figures 1, 2:
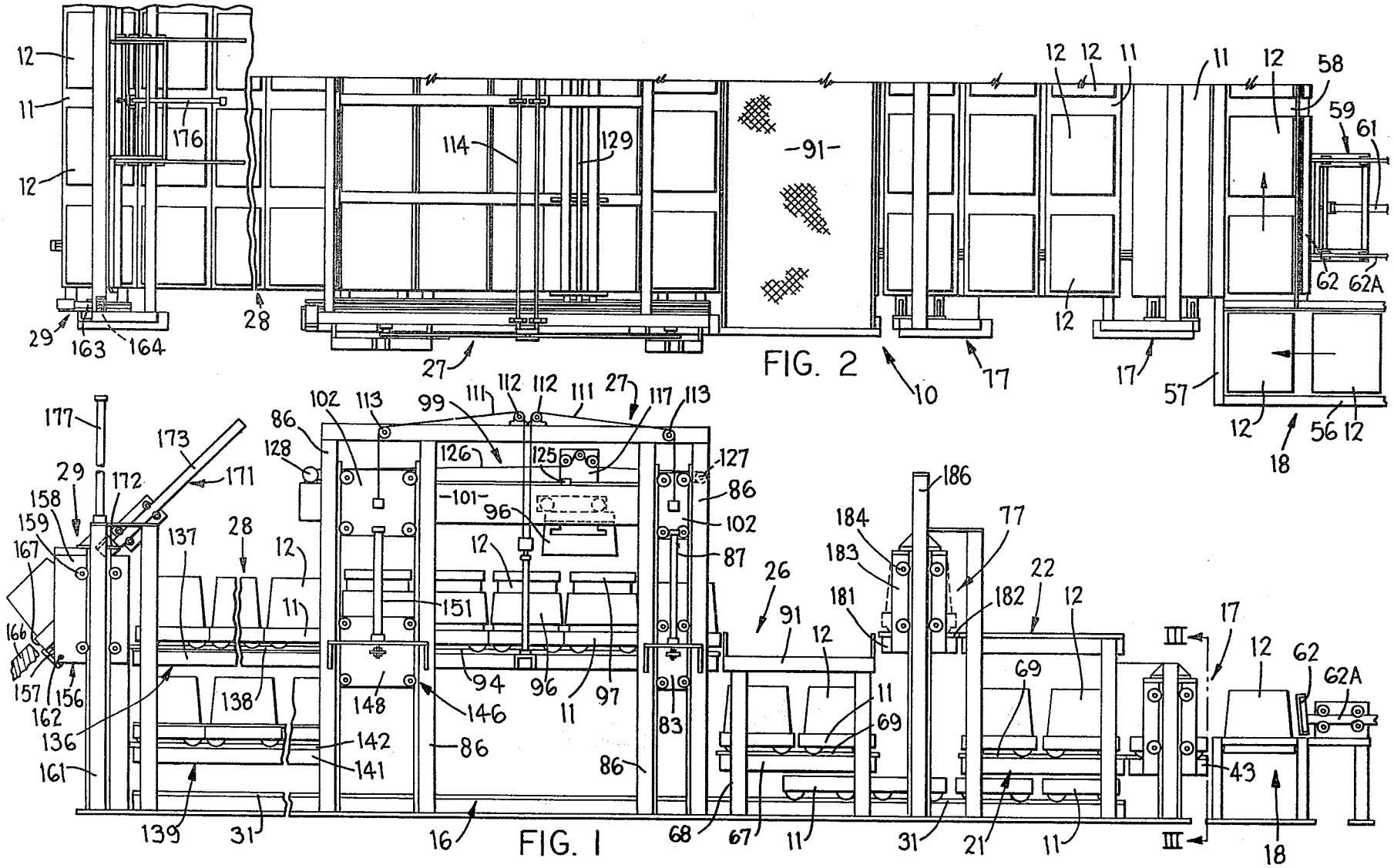
FIG. 1 is a side elevational view illustrating one embodiment of the present invention.
FIG. 2 is a fragmentary plan view of the system illustrated in FIG. 1.

FIGS. 1 and 2 illustrate therein a mold handling system 10 according to the present invention. This system incorporates a closed looplike path for permitting recirculation of cars 11 adapted to removably support thereon conventional foundry molds 12. In the illustrated embodiment, each car 11 is illustrated as supporting thereon four identical molds 12 in side-by-side relationship for permitting simultaneous handling of same, although it will be appreciated that the system of this invention is suitable for handling either a single mold or any reasonable number of molds on each car. The car 11 is substantially conventional and includes an upper horizontal support platform on which the mold is positioned, which platform in turn is suitably supported by two pairs of wheels 14 adapted to rollingly engage suitable guide rails or tracks.

The system 10, as illustrated by FIG. 1, includes an empty car return 16 which is disposed lowermost and extends longitudinally of the system. This empty car return 16, at its downstream end, terminates at a car lift station 17 which is positioned adjacent a mold delivery conveyor 18. From the lift station 17, the mold-bearing cars are supplied to an elevated pre-pour mold storage station 21 and, if necessary or desired, the system can additionally incorporate an auxiliary pre-pour mold storage station 22 for permitting storage of a larger number of mold-bearing cars. From the pre-pour storage station 21, the mold-bearing cars are supplied to a mold-car elevator associated with a pouring station 26, the latter being at the inlet end of the weight-and-jacket transfer station 27. After pouring, the mold-bearing cars are moved through station 27, are then moved through the mold cooling station 28, and are sequentially transferred to the mold dump and car lowering station 29, which latter station effectively removes the mold from the car and lowers the empty car back so as to be supplied along the empty car return 16.

Figures 7, 8, 9, 10:
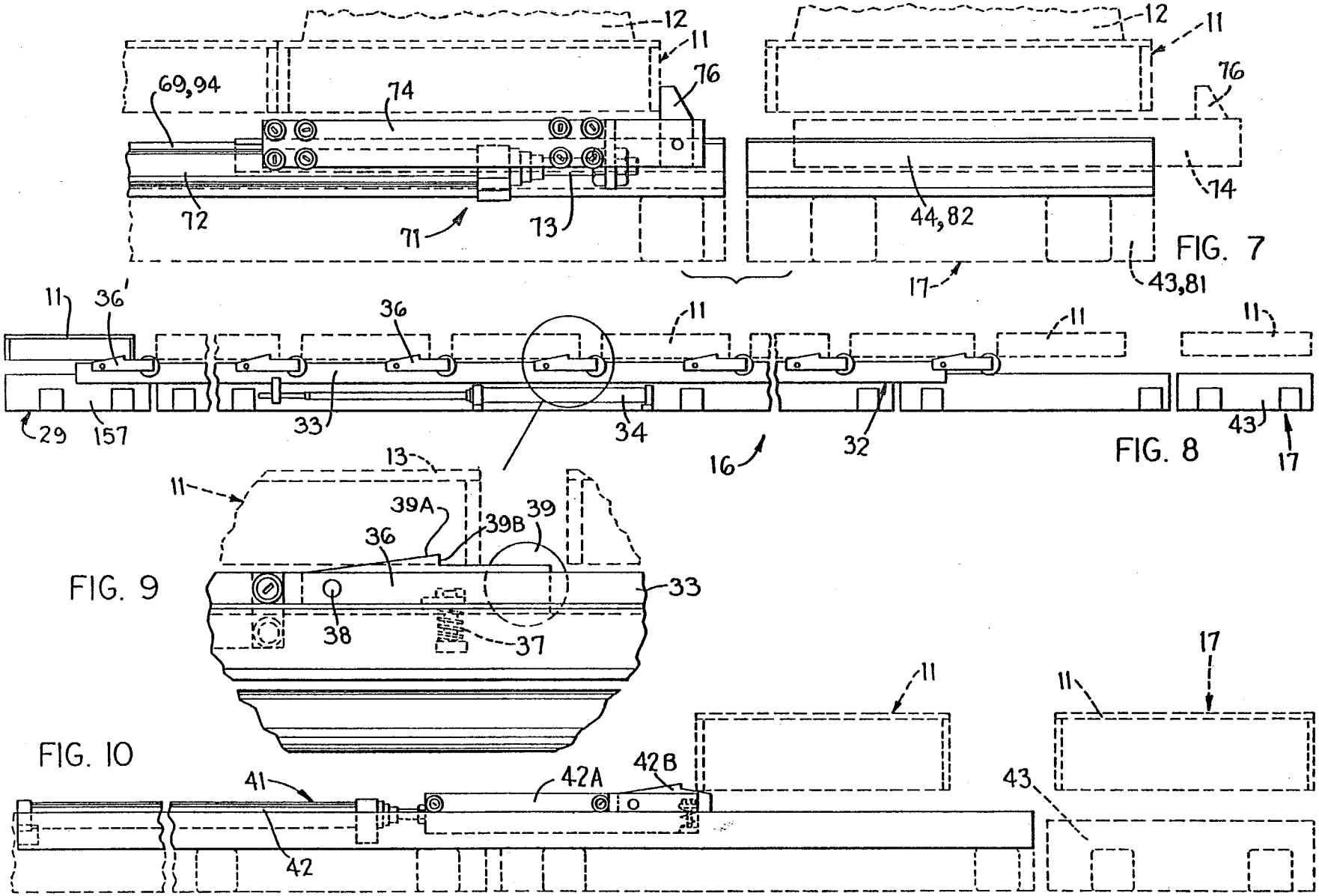
FIG. 7 diagrammatically illustrates one type of transfer mechanism for transferring cars onto or off of the various elevators.
FIG. 8 illustrates a walking beam arrangement for transferring empty cars along the return track.
FIG. 9 is an enlargement of part of FIG. 8.
FIG. 10 is an enlargement of the transfer mechanism at the downstream end of the walking beam arrangement.

Considering first the empty car return 16, same includes a pair of parallel tracks 31 which extend approximately horizontally throughout the length of the system and are stationarily supported on the frame substantially lowermost, the tracks 31 thus being normally positioned at an elevation adjacent or slightly above the floor. The empty cars 11 are sequentially and intermittently moved in a steplike manner along the tracks 31, as by a walking beam assembly 32 as shown in FIG. 8. This assembly 32 includes a horizontally reciprocal bar or beam 33 which is slidably supported on the frame and is horizontally reciprocated by a conventional fluid-pressure cylinder 34, the piston rod of which is connected to the reciprocating bar 33. This reciprocating bar 33 has a plurality of one-way dogs 36 pivotally mounted thereon at selected intervals, which dogs are urged into an uppermost position by a spring 37, with each dog being pivoted about a hinge 38. Each dog has a camming roller 39 thereon adjacent the free end of the dog, and the upper exposed surface of the dog has a ramplike cam 39A which terminates in a forwardly-facing shoulder or abutment 39B. With this mechanism, during the forward (rightward) reciprocation of bar 33, the shoulder 39B associated with each dog 36 engages one of the empty cars 11 and advances the car forwardly through a selected incremental distance equal to the stroke of the walking beam. During the retraction (leftward) movement of bar 33, the dog 36 cams downwardly against the urging of spring 37 so as to be retracted into a position for engagement with the next rearwardmost car. In the event that one or more cars are accumulated adjacent the forward (rightward) end of tracks 31, then the forwardmost dogs 36 will merely reciprocate back-and-forth inasmuch as the rollers 39 cause the dogs to be cammed downwardly beneath the cars during the forward stroke and hence permit continued reciprocation of the walking beam assembly so that the rearwardmost cars can be sequentially advanced, even though the cars have already fully accumulated adjacent the forward end of the track.

The walking beam assembly 32, as illustrated by FIG. 8, has a similar dog 36' at the rearward end thereof which engages and removes the empty car at the dumping and lowering station 29, as explained hereinafter, and moves it onto the tracks 31.

To effect transfer of the empty cars 11 from the forward or downstream end of the car return 16 onto the car lift station 17, there is provided a reciprocal car-pushing mechanism 41 (FIG. 10) which includes a conventional fluid-pressure power cylinder 42 having its reciprocal piston rod connected to a reciprocal roller carriage 42A which is provided with a one-way dog 42B. This dog is spring-urged upwardly and has a forwardly facing shoulder such that, when it is reciprocated forwardly (rightwardly), it engages the frontmost empty car on the walking beam and pushes it onto the elevator at the car lift station 17, whereupon when the dog 42B is retracted leftwardly, it cams downwardly to pass beneath the next frontmost empty car as the latter is moved to the front end of the car return 16 by the walking beam 32.

Figure 3:
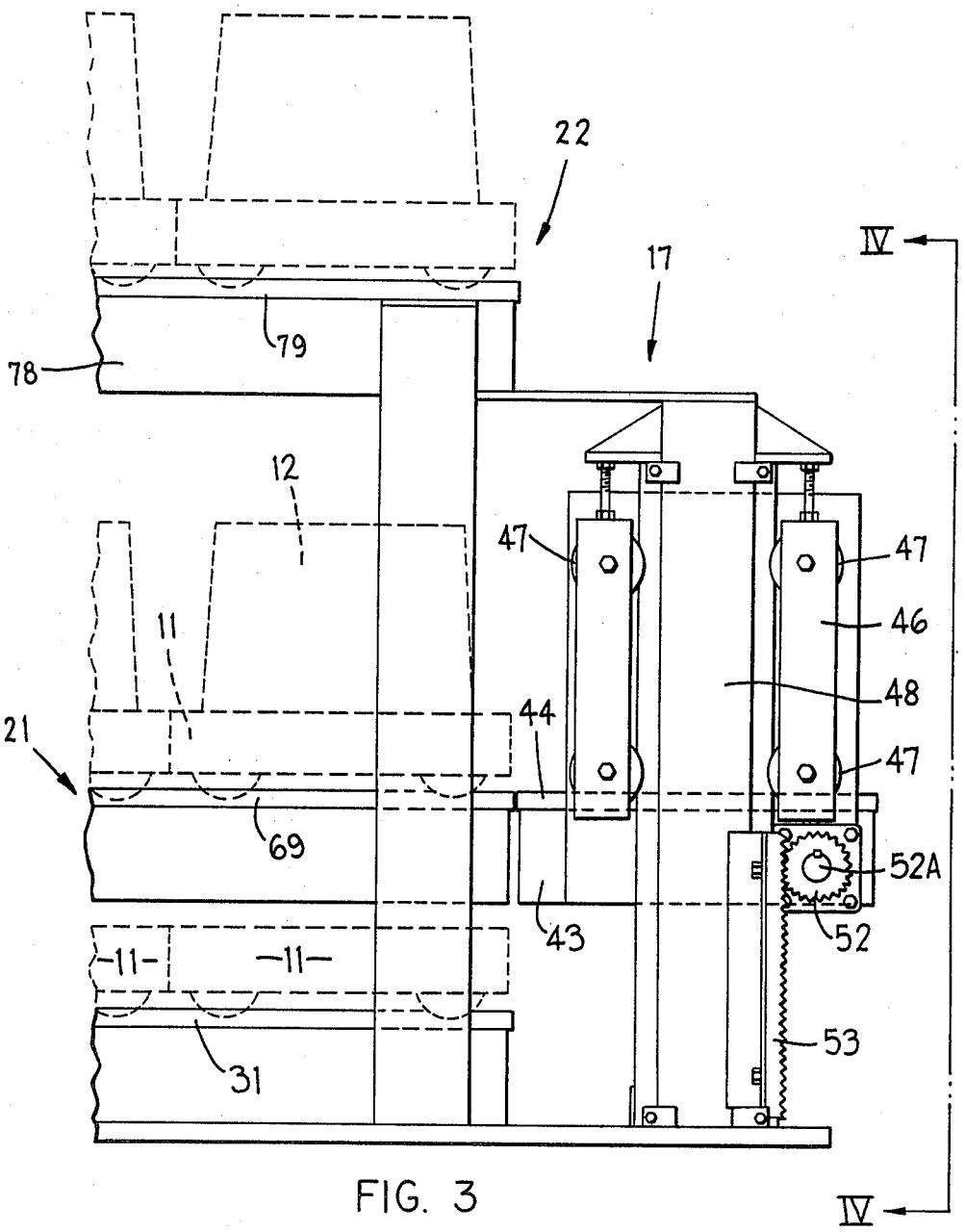
FIG. 3 is an enlarged side elevational view of the mold car lift station.
Figure 4:
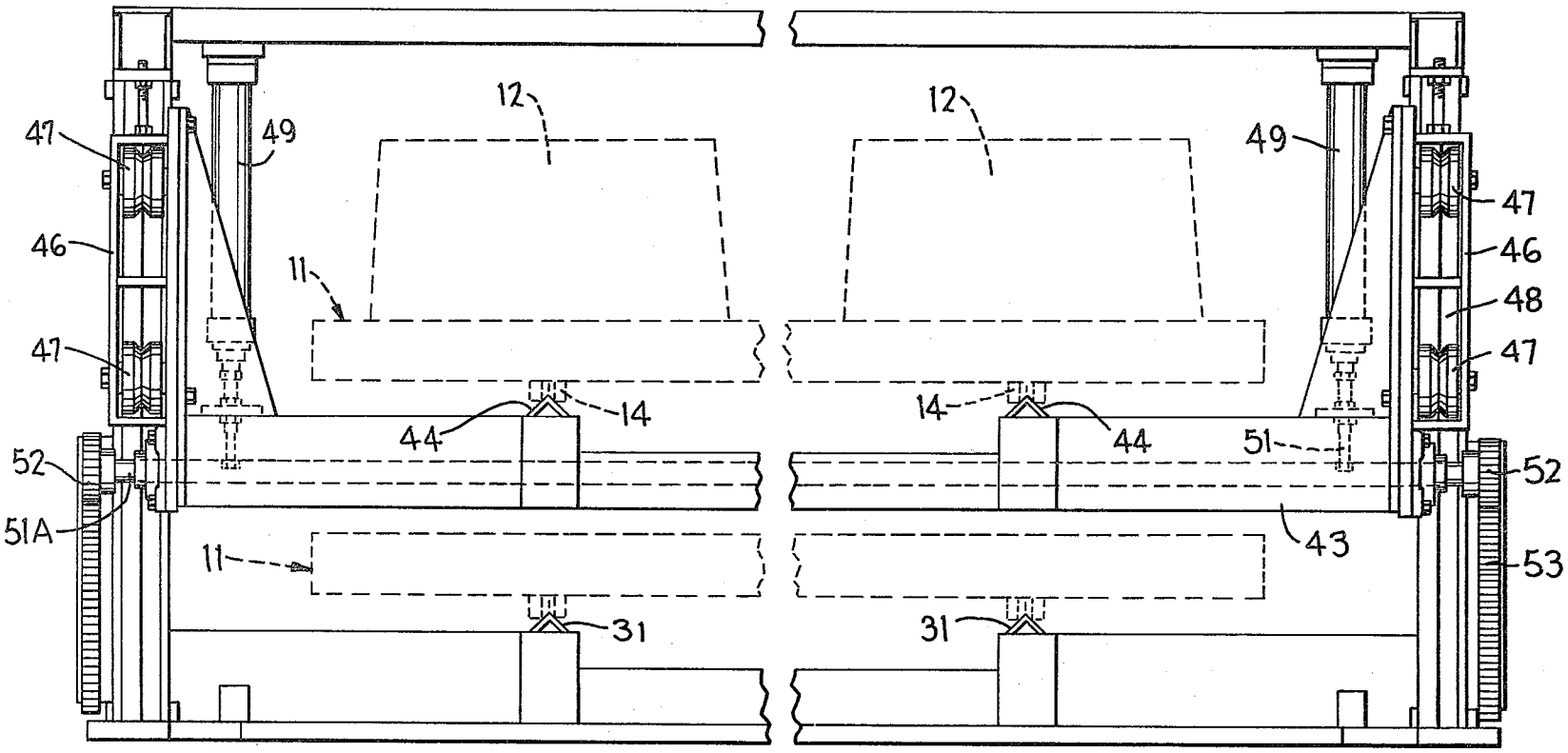
FIG. 4 is an end elevational view as taken substantially along line IV—IV in FIG. 3.

Considering now the car lift station 17 (FIGS. 3 and 4), same includes a platform or elevator 43 having parallel rails 44 on the upper surface thereof so that a car 11 can be supported thereon. The elevator 43 has a pair of upright carriages 46 fixed to and projecting upwardly from the opposite end edges thereof, and these carriages support appropriate rollers 47 which are rollingly engaged with opposite sides of stationary uprights 48 for confining the elevator solely for vertical movement. A pair of fluid-pressure cylinders 49 are mounted on and depend downwardly from a frame element which extends between the upper ends of the stationary uprights, and these power cylinders 49 have the piston rods 51 thereof connected to the elevator 43 for controlling the vertical reciprocation thereof. The elevator also has an elongated shaft 51A rotatably supported thereon and extending thereacross, which shaft has gears 52 secured on opposite ends thereof. These gears in turn are rollingly engaged with vertically elongated gear tracks 53 which are stationarily secured to the uprights 48. This gear-rack arrangement synchronizes the movement of the elevator adjacent the opposite edges thereof.

The power cylinders 49 move the elevator 43 between a lowermost position wherein the rails 44 thereon are aligned with the rails 31 associated with the car return 16, and an uppermost position wherein the elevator 43 is positioned directly adjacent and at substantially the same elevation as the mold delivery conveyor 18. When in this uppermost position, the elevator rails 44 are positioned substantially in alignment with rails associated with the pre-pour mold storage station 21.

The mold delivery conveyor 18 (FIG. 2) is of conventional structure and includes a main delivery conveyor 56, such as a roller conveyor, which delivers molds from a conventional molding machine. This conveyor 56 terminates in a conventional 90° transfer mechanism 57 which causes the molds to be transferred onto a transfer conveyor 58 which can also be a conventional roller or belt conveyor. This latter conveyor 58 is positioned parallel with and at the same elevation as the car 11 resting on the elevator 43 when the latter is in its raised position, and several molds 12 can be positioned on this transfer conveyor 58 so as to be simultaneously moved onto a single empty car 11. For this purpose, there is provided one or more appropriate transfer mechanisms 59 for pushing the molds from the transfer conveyor 58 onto the adjacent empty car 11.

The mold transfer mechanism 59, in the illustrated embodiment, includes a fluid-pressure power cylinder 61 having its piston rod secured to an enlarged pushing plate 62 which has elongated guide bars 62A thereon, the latter being movably supported on frame mounted guide rollers. When power cylinder 61 is energized, the pushing plate 62 is slidably extended forwardly to engage the molds 12 and slide them sidewardly (leftwardly) onto the adjacent mold car 11 which is stationarily positioned on the raised elevator 43.

The mold transfer mechanism 59 may obviously assume many other forms while still accomplishing the desired transfer operation. Further, the conveyors 56 and 58 and transfer 57 are also conventional so that detailed description of same is believed unnecessary.

Figure 12:
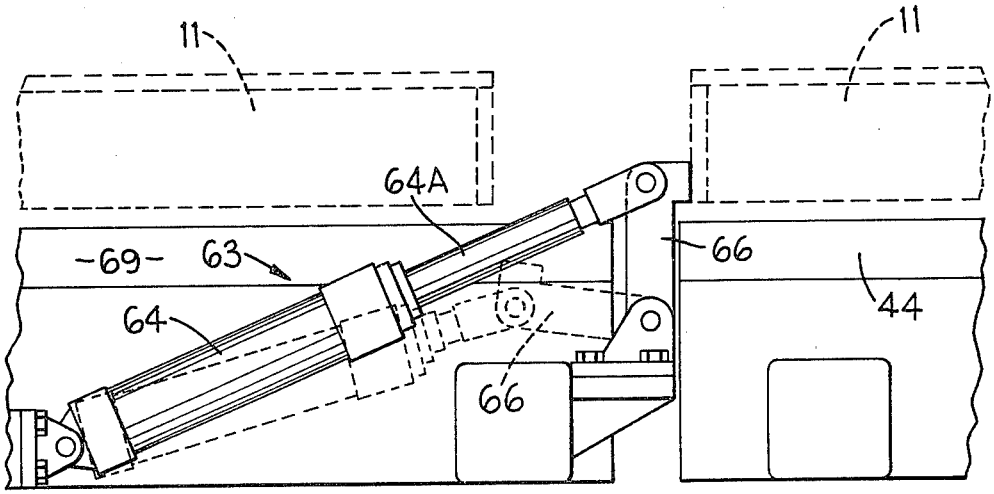
FIG. 12 illustrates the holding mechanism associated with the car lift station.

To hold the empty car 11 on the raised elevator 43 when the molds 12 are being pushed thereon, there is provided a holding mechanism 63 (FIG. 12) which is mounted on the frame of the apparatus adjacent the raised elevator 43. This holding mechanism 63 includes a power cylinder 64 having its piston rod 64A connected to latch 66. This latch is pivoted on the frame and, when the cylinder is energized into its extended (rightward) position, the latch 66 swings upwardly so as to overlap the edge of elevator 43 and engage the car 11 to hold it stationary as the molds 12 are pushed thereon.

The elevator 43, when in its raised position, is also at the same elevation and aligned with the inlet end of the pre-pour storage station 21. This station includes parallel elongated rails 69 for rollingly supporting thereon several mold-bearing cars. These rails 69 are supported on suitable stationary horizontal supports 67, which in turn are associated with upright frame elements 68. The rails 69 are suitably elongated so as to permit several cars to be rollingly stored in series thereon.

A suitable transfer mechanism 71 (FIG. 7) is provided for pulling the mold-bearing car from the raised elevator 43 onto the adjacent ends of rails 69. This transfer mechanism 71 includes a conventional fluid-pressure power cylinder 72 having its piston rod 73 connected to a slide 74 which is horizontally slidably guided on the frame for reciprocal displacement parallel to the rails 69. This slide 74 has a one-way dog 76 which is spring-urged into its upwardly-projecting position. The power cylinder is normally maintained in its retracted position so that the dog 76 does not interfere with the operation of elevator 43. By extending the power cylinder, the dog 76 will engage the car and the dog will pivot counterclockwise in opposition to the urging of its spring, whereupon the dog will pass under the car, and then return to its upwardly-projecting position. Retraction of the power cylinder, and hence of the dog, thus pulls the car off the elevator 43 onto the rails 69 associated with the pre-pour mold storage station 21.

The station 21 has a walking beam assembly (not shown) associated therewith, which can be identical to beam 32 as above described, for forwardly advancing the mold-bearing cars along the rails 69.

The mold handling system, as illustrated by FIGS. 1 and 2, may also be provided with the auxiliary pre-pour mold storage station 22 if additional storage capacity is desired or required. This auxiliary storage station 22 includes a pair of parallel rails 79 which are stationarily secured on horizontal supports 78, the latter being secured to the frame of the apparatus. These rails 79, which permit a series of mold-bearing cars to be rollingly stored thereon, are spaced upwardly from but are substantially parallel with the rails 69 associated with the main mold storage station 21. In fact, the rails 79 associated with station 22 are preferably positioned so that they extend at least partially over the primary mold storage station 21, with the rails 79 also extending over the mold car lift station 17 and the mold delivery conveyor 58 if desired. This arrangement permits the mold-bearing cars to be stored on at least two levels disposed directly one above the other.

To effect transfer of cars to or from the auxiliary storage station 22, there is additionally provided an auxiliary mold car lift station 77 which includes an elevator or platform 181 having parallel rails 182 thereon for supporting a mold-bearing car. The elevator 181 has carriages 183 which support thereon rollers 184, the latter being rollingly engaged with suitable upright frame elements 186. The elevator is raised and lowered by suitable fluid-pressure cylinders utilizing a drive mechanism substantially identical to that associated with the car lift station 17, as previously described.

This auxiliary mold car lift station 77, as illustrated by FIGS. 1 and 2, is disposed intermediate the main pre-pour mold storage station 21. That is, a section of the pre-pour mold storage station 21 is disposed upstream of the auxiliary lift station 77, and a further section is disposed downstream thereof. Hence, when the elevator 181 is in its lowermost position, its rails 182 are aligned with an effectively form a part of the rails 69 which define the main pre-pour mold storage station 21.

When this elevator 181 is provided, then the walking beam associated with storage station 21 is of two sections disposed on the upstream and downstream sides of the elevator 181. A separate pushing mechanism, like mechanism 71, is used for pulling a car onto the lowered elevator 181 from the upstream section of station 21. However, the walking beam associated with the downstream section of station 21 can be used for pulling the car off of the lowered elevator 181 onto the downstream part of station 21.

The auxiliary pre-pour mold storage station 22, and its associated auxiliary car lift station 77, are totally optional and can be deleted from the system if desired. If eliminated, then the main pre-pour mold storage station 21 would be continuous and of any desired length.

If used, the auxiliary storage 22 preferably has a two-way walking beam (not shown) associated therewith to permit the cars to be moved into or removed therefrom. Car transfer mechanisms, like mechanism 71 but having both pulling and pushing capabilities, are provided to move cars on or off the raised elevator 181. However, the cars can be manually moved if desired.

Figure 5:
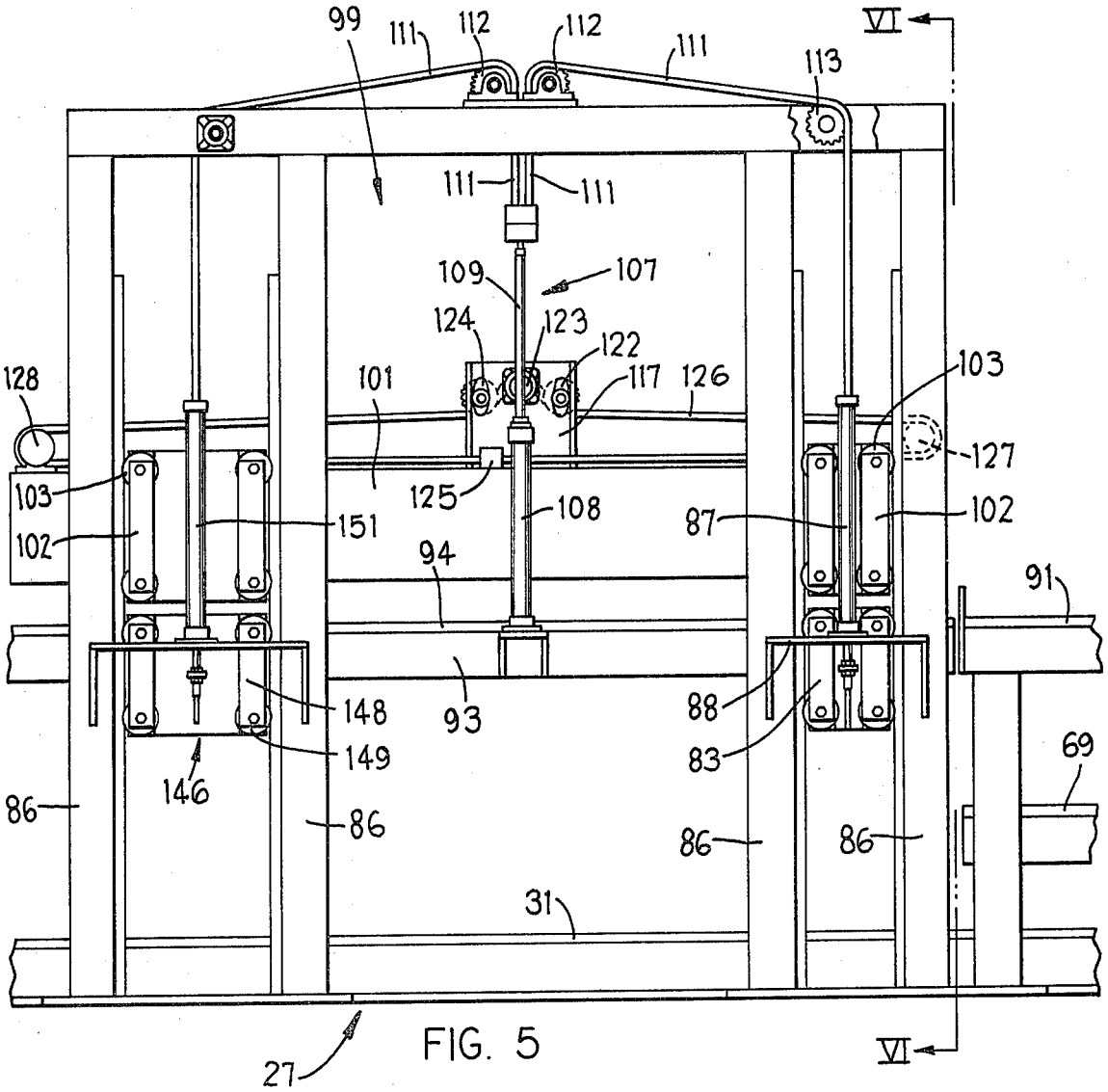
FIG. 5 is an enlarged side elevational view showing the jacket-and-weight transfer station.

The downstream or forward end of the main pre-pour mold storage station 21 communicates with the pouring station 26 which includes a vertically reciprocal elevator or platform 81 (FIGS. 5 and 6) having parallel rails 82 thereon for supporting a single mold-bearing car. This elevator 81 includes carriages 83 which are fixed to the opposite edges thereof, which carriages in turn mount rollers which are rollingly engaged with upright frame elements 86. Suitable fluid-pressure power cylinders 87 are mounted on brackets 88 which are secured to the upright frame elements, and the piston rods of these power cylinders are connected to the elevator 81 for effecting vertical raising and lowering of same. These cylinders move the elevator 81 between raised and lowered positions. When in the lowered position, the elevator is aligned with the downstream end of the main pre-pour mold storage station 21, so that a single car can be rolled from rails 69 onto the rails 82 associated with the elevator 81. The mold car is moved onto the lowered elevator 81 by a suitable transfer mechanism which is substantially identical to mechanism 71 (FIG. 7) described above except that it effects a pushing of the mold car onto the elevator. For this purpose, the configuration and hinging movement of the dog is reversed in contrast to that of mechanism 71 described above, but in all other respects is the same.

When the elevator 81 is in its raised position, it is aligned with and substantially at the same elevation as a pouring deck 91. This pouring deck 91 comprises a horizontally enlarged planar floor-like support for the operating personnel who control the mold-pouring operation. This platform is positioned so that it extends directly over at least a portion of the main pre-pour mold storage station 21 so that some of the mold-bearing cars are stored and pass directly beneath the pouring deck or platform 91 prior to their being supplied to the elevator 81. Since this portion of the main pre-pour mold storage station 21 is also positioned directly over the empty car return 16, the latter also passes beneath the pouring deck 91, which deck is thus raised relative to the elevation of the surrounding floor on which the overall apparatus is supported.

The pouring deck 91 extends substantially across the full width of the apparatus, which width corresponds to the width of the car 11, so that the operating personnel thus have convenient access to all of the molds supported on the car to permit pouring of molten metal into the respective molds. This pouring of molten metal into the molds, which can be done utilizing any conventional equipment or methods, is accomplished while the car is supported on the raised elevator 81.

Figure 6:
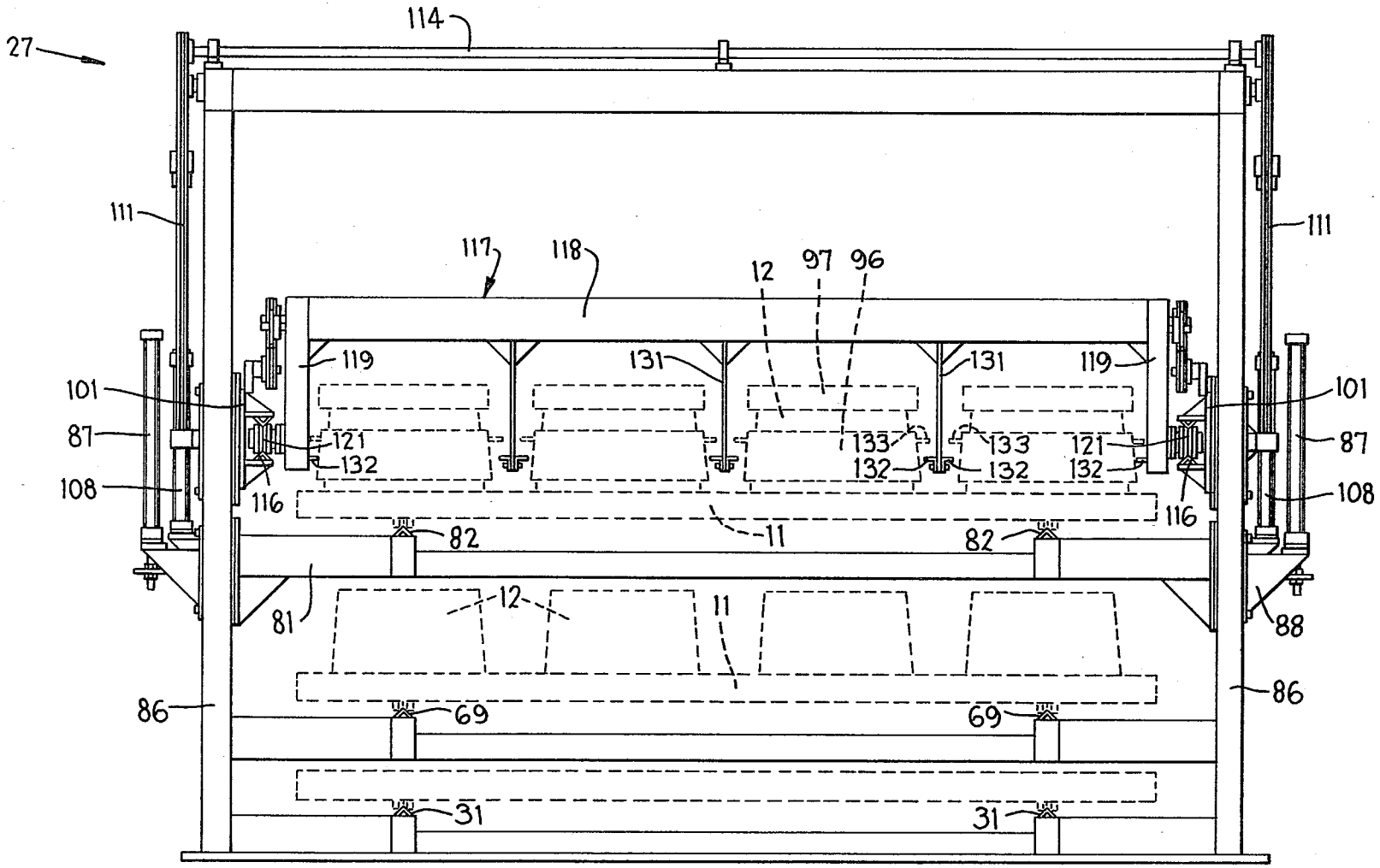
FIG. 6 is an end elevational view taken substantially along line VI—VI in FIG. 5.

Prior to pouring of molten metal into the molds 12, a conventional sleevelike jacket 96 is positioned around each mold 12, and a weight 97 is positioned on top of each mold, to support and reinforce the mold both during pouring and during initial metal solidification. The positioning of jacket 96 and weight 97 on the mold 12, and the subsequent removal of same, is automatically accomplished by a weight-jacket positioning and transfer mechanism 99 as associated with the station 27. This latter station, as shown in FIGS. 1–2 and 5–6, extends through a substantial distance and permits several mold-bearing cars to be movingly stored therein on elongated parallel rails which are stationarily supported on frames or supports 93. These rails 94, which rollingly support the mold-bearing cars, are at the same elevation as and are aligned with the rails 82 when the elevator 81 is in its raised position as shown in FIG. 6.

The weight-jacket positioning and transfer mechanism 99 includes an elevator or platform 101, the two parts of which are adjacent opposite sides of the system and extend longitudinally thereof. The platform 101, at opposite ends thereof, has carriages 102 mounting thereon guide rollers 103 which are rollingly engaged with the upright frame elements 86 for enabling the elevator 101 to vertically reciprocate in response to energization of a drive mechanism 107. This latter drive mechanism 107 includes, adjacent each side of the system, a fluid-pressure power cylinder 108 which has its reciprocal piston rod 109 connected to one end of a pair of chains 111. These chains pass upwardly around appropriate idler sprockets 112, which chains then pass toward opposite ends of the elevator and pass around further idler sprockets 113, whereby the opposite ends of the chains are suitably anchored to the opposite ends of the elevator 101. The idler sprockets 112 disposed adjacent opposite sides of the system are nonrotatably connected by a transverse shaft 114 so as to synchronize movement of the opposite sides of the elevator 101.

This last-mentioned elevator 101 defines thereon a pair of horizontally elongated guide rails 116 which are disposed in opposed relationship to one another adjacent opposite sides of the system. These rails 116 extend in parallel relationship with the rails 94, and a trolley 117 extends between and is rollingly supported on the rails 116. This trolley 117 includes a transversely extending top bar 118 which terminates in downwardly-projecting side bars 119, the latter having a pair of rollers 121 suitably engaged with and confined by the guide rails 116.

The trolley 117 rotatably mounts thereon three chain sprockets 122, 123 and 124 which are suitably engaged with an endless driving chain 126, which chain is fixedly anchored to trolley 117 at 125. This chain 126 in turn extends between a further pair of rotatable sprockets 172 and 128 which are mounted on elevator 101 adjacent the opposite ends thereof. The one sprocket 128 has a suitable rotary drive motor, such as a pneumatic motor, associated therewith for effecting reversible driving displacement of chain 126, which in turn causes the trolley 117 to be linearly moved forwardly or backwardly in the longitudinally direction of the elevator 101. The sprockets 123 adjacent opposite sides of the trolley are joined by a shaft 129 to insure synchronous driving of both sides of the trolley. To permit handling of the jackets and weights, the trolley 117 has a plurality of intermediate lifting hangers 131 secured to and projecting downwardly from the top bar 118, which hangers at their lower ends have sidewardly-projecting lifting tabs 132. Similar lifting tabs 132 also project inwardly from the side bars 119. These lifting tabs 132 are disposed so as to be engageable with sidewardly-projecting tabs 133 which are fixed to each jacket 96 so as to permit the jacket to be lifted upwardly out of engagement with the mold 12 when the trolley 117 is lifted upwardly due to raising of elevator 101.

In operation, the elevator 101 is maintained in its lowermost position and the trolley 117 is advanced forwardly (leftwardly in FIG. 1) so that the hanger tabs 132 pass by the mold cars, as shown in FIG. 6, whereby the jackets 96 remain on the molds as the cars are pushed through station 27 to permit at least partial metal solidification. When the trolley 117 reaches the forward end of elevator 101, the elevator 101 is raised upwardly so that the lifting tabs 132 engage the jacket tabs 133 and hence cause the jackets 96 and weights 97 to be lifted upwardly away from the molds on the frontmost car. When the elevator 101 reaches its uppermost position, the trolley 117 is then moved backwardly (rightwardly in FIG. 1) until it reaches the rearward end of elevator 101, in which position the trolley 117 is thus substantially aligned over the pouring station 26. The elevator 101 is then lowered, and substantially simultaneously therewith the pouring station elevator 81 is lifted upwardly, which results in jackets 96 and weights 97 being deposited on the molds as the elevator 81 reaches its uppermost position. The elevator 101 continues downwardly such that the lifting tabs 132 are spaced downwardly from the jacket tabs 133, and hence the trolley 117 can again move forwardly to initiate a new cycle, as explained above. This movement of the jackets and weights occurs in cyclic relationship with the transfer of the mold-bearing car from the pouring elevator 81 onto the rails 94 associated with the weight-and-jacket transfer station 27, which transfer is accomplished by means of a pull-type transfer mechanism corresponding to the mechanism 71 of FIG. 7. This pulling of a car from elevator 81 onto rails 94 causes the cars to be pushed through the station 27.

After the weights and jackets have been removed from the molds, as previously explained, the mold-bearing cars are then moved into and through the cooling station 28. This latter station, as illustrated in FIG. 1, includes a primary cooling area 136 and may also include a secondary cooling area 139 disposed thereunder. The primary cooling area 136 includes parallel and horizontally elongated rails 138 which are secured to stationary supports 137 for permitting the mold-bearing cars to be rollingly pushed therethrough. These rails 138 are aligned with rails 94 which extend through station 27. The length of rails 138 is selected so as to permit the molds to be adequately cooled prior to dumping of same from the cars. To permit the overall length of this cooling area to be shortened, or in the alternative to permit a greater quantity of mold cars to be stored in the cooling area, the secondary cooling area 139 can be provided. The latter area 139 is positioned directly below and extends in parallel relationship with the primary cooling area 136. The secondary cooling area 139 also includes elongated horizontally-extending parallel rails 142 which are mounted on stationary supports 141, with these rails 142 being disposed directly below the rails 138. The mold-bearing cars, when in the cooling station 28, can thus be stored and movably advanced on at least two levels so that two rows of cars are positioned one above the other.

When using this two-level cooling arrangement, a further elevator 146 is located at the discharge end of station 27 for permitting the mold-bearing cars to be selectively positioned on either cooling level. This elevator 146 has rails (not shown) thereon which, when the elevator 146 is uppermost, are aligned with and bridge the gap between rails 94 and 138. This elevator 146 has carriages 148 mounting thereon rollers 149 which are rollingly engaged with the upright frame elements 86. Suitable power cylinders 151 are mounted on the frame and have their piston rods connected to the elevator 146 for causing the latter to be suitably vertically reciprocated between raised and lowered positions. When the elevator 146 is in its raised position, it creates a direct bridge between the rails 94 and 138, so that the mold-bearing cars are pushed directly from the jacket-and-weight transfer station 27 across the elevator 146 onto and through the primary cooling area 136. However, when storage on the secondary cooling area 139 is desired, the elevator 146 is moved to its lowered position and the mold-bearing car thereon is pulled off of the elevator 146 onto the lowermost rails 142, as by means of a pulling mechanism identical to the transfer mechanism 71 described above, which thus causes the cars to be pushed through cooling area 139.

Figure 11:
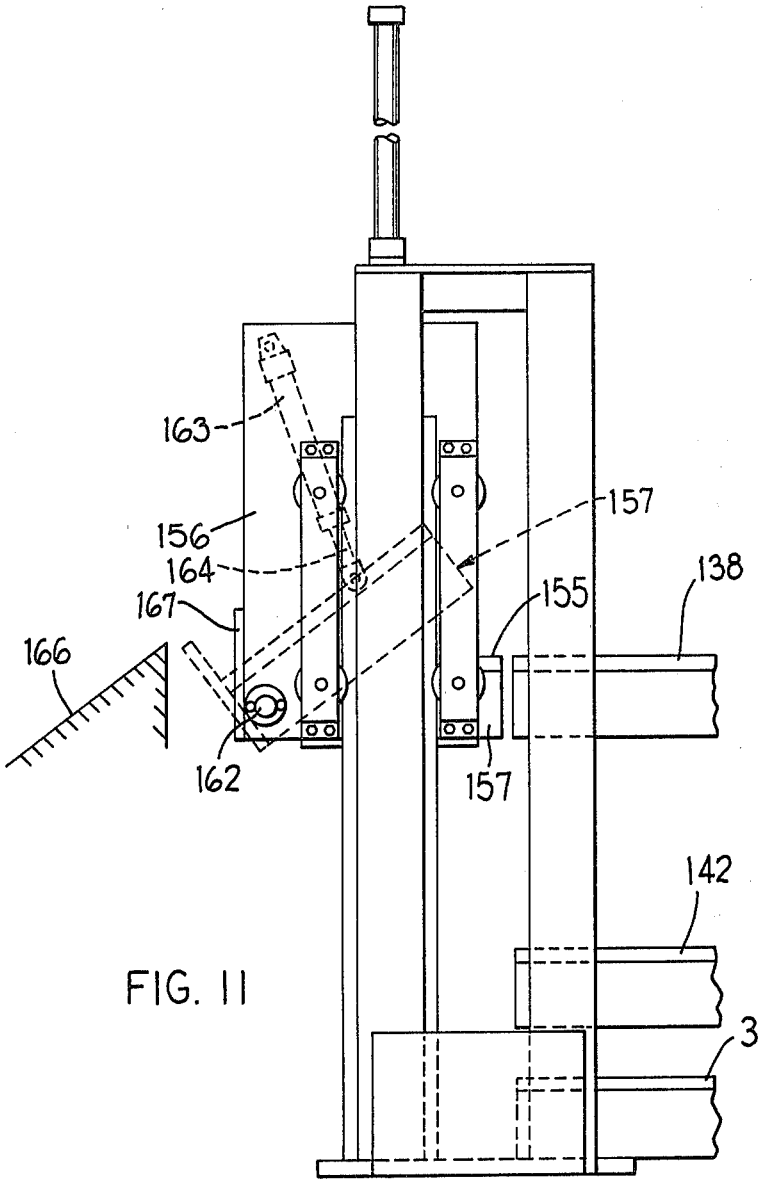
FIG. 11 is an enlarged side elevational view of the mold dumping station.

After travelling through the cooling station 28, the mold-bearing cars are then transferred to the mold-dump and car-lowering station 29. This latter station (FIGS. 1 and 11) also includes an elevator 156 having a platform 157 provided with car-support rails 155 thereon. Carriages 158 are secured to the opposite ends of the elevator and mount thereon rollers 159 which are rollingly engaged with upright frame elements 161 so that the elevator can be vertically raised and lowered. The elevator 156, when in its raised position, is aligned with the primary cooling area 136 so that the frontmost mold-bearing car is pushed onto the elevator 156 due to a further car being pushed from elevator 146 onto the upstream end of rails 138.

To permit dumping of the molds from the car, the elevator platform 157 is mounted for pivoting movement about a horizontally-extending pivot 162 which is located adjacent the forward corner of the elevator. A power cylinder 163 is pivotally mounted on the elevator and has its piston rod 164 pivotally connected adjacent the rear edge of the platform 157 so that when the power cylinder is contracted, the platform 157 is tilted upwardly (counterclockwise about pivot 162) so that the mold slides off of the car and falls into a dump chute 166. The platform 157 has a retaining flange 167 along the front edge thereof for retaining the car during tilting.

A brush assembly 171 is positioned above the elevator 156 for cleaning off the upper surface of the car after dumping. This brush assembly 171 includes an elongated brush 172 which is secured to a pair of elongated reciprocal guide rods 173 which are rollingly supported on the frame. The brush is reciprocated by a conventional fluid-pressure power cylinder 176. Extension of the power cylinder causes the brush to be projected outwardly and downwardly so as to move across the tilted car so as to effect cleaning of same. When the brush is retracted, then the platform 157 is tilted back into its level or horizontal position. Thereafter the elevator 156 is lowered by power cylinder 177 until the elevator reaches its lowermost position, in which position it is aligned with the rails 31 associated with the empty car return 16, whereupon the walking beam assembly 32 removes the empty car from the platform 157 and pulls it onto the rails 31.

When the secondary cooling area 139 is utilized, then the elevator 156 is also lowered into an intermediate position wherein it is aligned with the secondary cooling area 139, whereupon the frontmost mold-bearing car within this area is pushed onto the elevator due to a further car being pulled off of lowered elevator 146 onto rails 142 of cooling area 139. The elevator 156 is then raised upwardly into alignment with the upper cooling area, following which the elevator is tilted to dump the molds in the same manner as previously described.

As indicated by the structure and operation described above, the mold-bearing cars are serially pushed throughout the system after leaving the pouring station, and thus a substantially continuous series of cars is present throughout the subsequent stations up to the dumping station. However, since the pouring of molds at the pouring station is dependent upon the supply of molten metal, which normally occurs at irregular intervals of time, the provision of the main and auxiliary pre-pour mold storage areas 21 and 22 enables a continuous production of molds and the storage of same on cars. Since the production of molds normally individually requires more time than the individual pouring operation, a substantial quantity of molds can thus be produced and stored during non-pouring intervals, which molds are thus readily and conveniently available for pouring whenever the molten metal is available.

Conventional limit or proximity switches or sensors are associated with elevators 146 and 156 for sensing the positions thereof, and for controlling the feeding of further cars into stations 27 and 28, so that the cars will not be pushingly advanced until the elevators 146 and/or 156 are properly positioned so as to receive thereon one of the downstream cars. Numerous controls of this type are well known, and the application of same is conventional and well understood.

It will be appreciated that auxiliary pre-pour mold storage station 22 and secondary mold cooling station 139 can each be eliminated, in which case the respective elevators 77 and 146 would similarly be eliminated.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An apparatus for handling molds supported on cars which have pairs of wheels for permitting rolling displacement of the cars, said apparatus comprising:

first elongated guide rail means for permitting empty mold cars to be rollingly moved therealong in a first direction from one end of said first rail means toward its other end, said first rail means extending approximately horizontally;

second guide rail means positioned above and approximately vertically aligned with said first rail means for permitting mold-bearing cars to be rollingly moved therealong in a second direction which is opposite said first direction, said second rail means being horizontally elongated and having a first end thereof disposed substantially directly over said other end of said first rail means, and said second rail means having a second end thereof disposed substantially directly over said one end of said first rail means;

first elevator means positioned directly adjacen said other end of said first rail means for vertically lifting mold cars from said first rail means adjacent said other end to said second rail means adjacent said first end;

means for positioning a preformed mold on each empty mold car when the latter is supported by said first elevator means;

said second rail means including a first horizontally-elongated rail section which extends from said first end through a selected distance to a first location for permitting mold-bearing cars to be rollingly supported thereon;

horizontal pouring deck means positioned vertically above at least a portion of said first rail section so that the mold-bearing cars pass under said deck means as the cars move toward said first location, said deck means being positioned directly adjacent said first location and extending therefrom in a direction upstreamm of said first rail section;

second elevator means disposed at said first location for vertically raising the mold-bearing cars from said first rail section into a raised position adjacent said deck means for permitting molten metal to be poured into the mold;

said second rail means including a second horizontally-elongated rail section which extends from said first location downstream to a second location, said second rail section being vertically spaced upwardly relative to said first rail section so as to receive thereon the mold-bearing car when the second elevator means is in said raised position;

pouring means positionable adjacent said second elevator means for pouring of the mold when the mold-bearing car is in said raised position at said first location;

handling means for positioning a sleevelike jacket on the mold prior to pouring of the mold when the mold-bearing car is in said raised position at said first location, and for removing the jacket from the mold after the mold-bearing car has been moved along said second rail section into said second location;

said handling means including elongated trolley rail means extending horizontally between said first and second locations and vertically above said second rail section, driving means for vertically raising and lowering the trolley rail means between upper and lower positions, a trolley rollingly supported on the trolley rail means and means to drive the trolley horizontally back-and-forth along the trolley rail means between said first and second locations, engaging means attached to the trolley to engage the mold jackets to raise and lower the mold jackets in response to the respective raising and lowering of the trolley rail means by said driving means, and said driving means and said means to drive the trolley being arranged downstream in said second direction of said pouring means;

said second rail means including a third horizontally-elongated rail section which extends from said second location downstream to said second end, said third rail section permitting the mold-bearing cars to be rollingly moved therealong for permitting cooling of the molds;

third elevator means located at the second end of said second rail means for vertically lowering the car from said second rail means downwardly for engagement with said first rail means adjacent said one end thereof; and means for removing the mold from the car prior to the car being returned to said first rail means.

2. An apparatus according to claim 1, wherein said second rail means includes a fourth horizontally-elongated rail section which extends from said second location to said second end and is vertically interposed between said first rail means and said third rail section, whereby additional mold-bearing cars can be rollingly moved along said second rail means for permitting cooling of the molds, said third elevator means being disposed adjacent the downstream end of said fourth rail section, and fourth elevator means disposed at said second location for permitting some of the mold-bearing cars to be selectively lowered from said second rail section downwardly onto the upstream end of said fourth rail section, said third rail section being aligned with and at substantially the same elevation as said second rail section.

3. An apparatus according to claim 1, wherein the mold-removing means includes means for vertically tilting said third elevator means for permitting the mold to be removed from the car supported thereon.

4. An apparatus according to claim 1, including third horizontally-elongated rail means positioned vertically upwardly from and overlying at least a portion of said first rail section for providing additional storage of mold-bearing cars thereon prior to pouring, and fourth elevator means disposed at a third location disposed between said first location and said first end of said first rail section for permitting mold-bearing cars to be movably displaced between said first rail section and said third rail means.

5. An apparatus according to claim 1, including walking beam means associated with and extending longitudinally along said first rail means for permitting empty mold cars to be intermittently moved in a steplike manner along said first rail means in said first direction, said walking beam means including means associated with the upstream end thereof for removing an empty mold car from said third elevator means when the latter is in a lowermost position for moving the empty mold car onto the upstream end of said first rail means;

first drive means disposed adjacent said other end of said first rail means for movably displacing an empty car from said first rail means onto said first elevator means when the latter is in its lowered position adjacent said first rail means;

said mold positioning means including support means for supporting thereon a preformed mold at a position and elevation directly adjacent said first elevator means when the latter is in its raised position substantially in alignment with said first end of said first rail section, said mold positioning means also including mold-transfer means for movably displacing the mold from said support means onto the empty car disposed on said first elevator means when the latter is in said raised position; and said first rail section being positioned vertically above but closely spaced to said first rail means for providing minimum vertical spacing therebetween solely so as to enable empty cars as supported on said first rail means to pass under said first rail section, portions of both said first rail means and said first rail section passing directly under said pouring deck means.

6. An apparatus according to claim 1, wherein each car is of substantial width to simultaneously support thereon a plurality of molds in side-by-side relationship.

7. An apparatus according to claim 1, including:

third horizontally-elongated rail means positioned vertically upwardly from said first rail section for providing additional storage of mold-bearing cars thereon prior to pouring, and fourth elevator means at a third location disposed between said first location and said first end of said first rail section for permitting mold-bearing cars to be movably displaced between said first rail section and said third rail means; and said second rail means including a fourth horizontally-elongated rail section which extends from said second location to said second end and is vertically interposed between said first rail means and said third rail section, whereby additional mold-bearing cars can be rollingly moved along said second rail means for permitting cooling of the molds, said third elevator means being disposed adjacent the downstream end of said fourth rail section, and fifth elevator means disposed at said second location for permitting some of the mold-bearing cars to be selectively lowered from said second rail section downwardly onto the upstream end of said fourth rail section, said third rail section being aligned with and at substantially the same elevation as said second rail section.

8. An apparatus according to claim 7, wherein said first rail section includes a first elongated part which extends from said first end of said first track section to said third location, said first rail section also including a second elongated part which is horizontally aligned with said first part and extends from said third location to said first location, said third rail means overlying said first elongated part, and said deck means extending horizontally between said first location and said third location in overlying relationship to said second elongated part.

9. An apparatus according to claim 7, including walking beam means associated with and extending longitudinally along said first rail means for permitting empty mold cars to be intermittently moved in a steplike manner along said first rail means in said first direction, said walking beam means including means associated with the upstream end thereof for removing an empty mold car from said third elevator means when the latter is in a lowermost position for moving the empty mold car onto the upstream end of said first rail means;

first drive means disposed adjacent said other end of said first rail means for movably displacing an empty car from said first rail means onto said first elevator means when the latter is in its lowered position adjacent said first rail means;

said mold positioning means including support means for supporting thereon a preformed mold at a position and elevation directly adjacent said first elevator means when the latter is in its raised position substantially in alignment with said first end of said first rail section, said mold positioning means also including mold-transfer means for movably displacing the mold from said support means onto the empty car disposed on said first elevator means when the latter is in said raised position; and said first rail section being positioned vertically above but closely spaced to said first rail means for providing minimum vertical spacing therebetween solely so as to enable empty cars as supported on said first rail means to pass under said first rail section, portions of both said first rail means and said first rail section passing directly under said pouring deck means.

10. An apparatus according to claim 1, wherein said handling means includes stationary vertical upright means for vertically rollingly guiding said trolley rail means for vertical displacement between said upper and lower positions, said driving means including elongated flexible means connected to and suspendingly supporting said trolley rail means for controlling the raising and lowering thereof.

11. An apparatus according to claim 1, wherein said engaging means includes a pair of hooks which are fixed to said trolley means and project downwardly therefrom in sidewardly spaced relationship so as to straddle and engage a respective mold jacket on opposite sides thereof, said hooks causing the jacket to be automatically deposited on the mold when the trolley is in said first location and the trolley rail means is moved into its lower position, said trolley being movable forwardly into said second location when the trolley rail means is in its lower position whereby the hooks freely move past the mold-bearing cars located on said second rail section, said hooks automatically engaging the mold jacket at said second location and lifting same upwardly when the trolley is at said second location and said trolley rail means is raised into its upper position, said drive means causing the trolley to then move rearwardly along the raised trolley rail means back to said first location while maintaining the weight jacket suspended on the trolley so as to position it above the mold-bearing car disposed at said first location.

12. An apparatus for handling molds supported on cars which have wheels for permitting rolling displacement of the cars, said apparatus comprising:

elongated guide rail means having horizontally elongated upper and lower portions vertically spaced from one another for permitting the cars to cyclically move through a substantially endless vertical loop;

said rail means including a first horizontally elongated rail section for permitting empty mold cars to be rollingly moved therealong from a first location disposed adjacent one end of said first rail section toward a second location disposed adjacent the other end of said first rail section;

said rail means including a second horizontally elongated rail section which extends from said second location through a selected horizontal distance to a third location for permitting mold-bearing cars to be rollingly supported thereon and moved from said second location to said third location;

means positioned directly adjacent said second location for positioning a preformed mold on each empty mold car when the latter is at said second location;

elevated, horizontally extending pouring deck means positioned adjacent said third location at an elevation substantially above said second rail portion;

elevator means disposed at said third location for vertically raising the mold-bearing cars from said second rail section upwardly into a raised position adjacent said deck means for permitting molten metal to be poured into the mold supported on the respective car;

pouring means positionable adjacent said third location for pouring of the mold when the mold-bearing car is in said raised position at said third location;

said rail means including a third horizontally elongated rail section which extends from said third location downstream to a fourth location, said third rail section being vertically spaced upwardly relative to said second rail section so as to receive thereon the mold-bearing car when the elevator means is in said raised position;

handling means associated with and positioned above said third rail section for positioning a sleevelike jacket on the mold prior to pouring of the mold when the mold-bearing car is in said raised position at said third location, and for removing the jacket from the mold after the mold-bearing car has been moved along said third rail section into said fourth location, and for then returning the removed jacket back to said third location for positioning on a further mold;

said handling means including elongated trolley rail means extending horizontally between said third and fourth locations and vertically above said third rail section, drive means to vertically raise and lower the trolley rail means between upper and lower positions, a trolley rollingly supported on the trolley rail means and means to drive the trolley horizontally back-and-forth along the trolley rail means between said third and fourth locations, engaging means attached to the trolley to engage the mold jackets to raise and lower the mold jackets in response to the respective raising and lowering of the trolley rail means, and means for controlling and synchronizing the movements of the trolley rail means and the trolley so that the mold jackets move along a closed vertical loop, said drive means and said means to drive the trolley being arranged downstream of the pouring means toward said fourth location;

said rail means including a fourth horizontally-elongated rail section which extends from said fourth location to said first location for permitting the mold-bearing cars to be rollingly moved therealong for cooling of the molds; and means at said first location for removing the mold from the respective car and for returning the car to said first rail section.

* * * * *